United States Patent [19]

Theis, Jr.

[11] 4,087,198

[45] May 2, 1978

[54] SPEED GOVERNED ROTARY DEVICE

[75] Inventor: James V. Theis, Jr., Delray Beach, Fla.

[73] Assignee: Hollymatic Corporation, Park Forest, Ill.

[21] Appl. No.: 756,250

[22] Filed: Jan. 3, 1977

[51] Int. Cl.[2] ..... F01D 1/18

[52] U.S. Cl. ..... 415/82; 32/27; 415/25; 415/214; 415/503

[58] Field of Search ..... 415/80, 82, 25, 214, 415/503, 204, 206; 32/27

[56] References Cited

U.S. PATENT DOCUMENTS

| | | | |
|---|---|---|---|
| 3,708,241 | 1/1973 | Theis, Jr. et al. | 415/80 |
| 3,733,143 | 5/1973 | Theis, Jr. | 415/80 |

*Primary Examiner*—C. J. Husar

*Attorney, Agent, or Firm*—Wegner, Stellman, McCord, Wiles & Wood

[57] ABSTRACT

A rotary device with a speed governor as a part of a centrifugally radially expandable rotor and having radially adjustable prestress means for preselecting the maximum speed at which the governor operates to limit the speed to this maximum. The rotor which contains both torque imparting means and governing means as integral parts is a hollow flexible rotor that expands radially under centrifugal forces to move the sides of the rotor toward each other during increasing centrifugal expansion with increasing speeds of rotation. The rotor also has a fluid valve that is moved toward closed position by the centrifugal expansion to govern the speed of the rotor to a preselected maximum.

9 Claims, 5 Drawing Figures

SPEED GOVERNED ROTARY DEVICE

BACKGROUND OF THE INVENTION

The field of this invention is pressurized fluid operated rotary devices having speed governors for limiting the speed of rotation to a desired maximum.

The most pertinent prior art of which applicant is aware is his own U.S. Pat. No. 3,733,143 assigned to the assignee hereof and the prior art listed therein. However, this prior art rotary device does not have the adjustability feature which permits the devices of this invention to be mass produced and then preset to a desired maximum speed setting so that if desired all rotors will be essentially the same in operation so far as maximum speed is concerned.

SUMMARY OF THE INVENTION

In this invention the rotor has torque imparting means including drive surfaces acted upon by the pressurized fluid for rotating the rotor. There is also included a fluid passage in the rotor to these torque imparting drive means and centrifugally operated valve means as a part of the rotor and in the fluid passage for restricting flow of pressurized fluid to the rotor imparting or drive elements at a selected speed of rotation to govern the speed to a preselected maximum. Thus in one embodiment the rotor is radially expandable under increasing centrifugal forces and the radial expansion is used to operate the fluid flow restricting valve means. In order that this maximum speed may be precisely set the invention also includes prestress elements so that now all of a number of rotors which may vary somewhat one from the other can be set to the substantially same maximum operating speed.

In a specifically disclosed embodiment of the invention substantially the entire rotor is constructed of a flexible material such as a thermoplastic elastomer so that the rotor is distorted radially under centrifugal force and is distorted laterally by the internal fluid pressure. This lateral expansion and contraction opens and closes the valve means and in order to set this lateral force precisely plastic means are included tending to prestress the rotor laterally inwardly which provides a lateral compression stress that must be overcome by the internal fluid pressure.

DESCRIPTION OF THE PREFERRED EMBODIMENT

Figure 1:
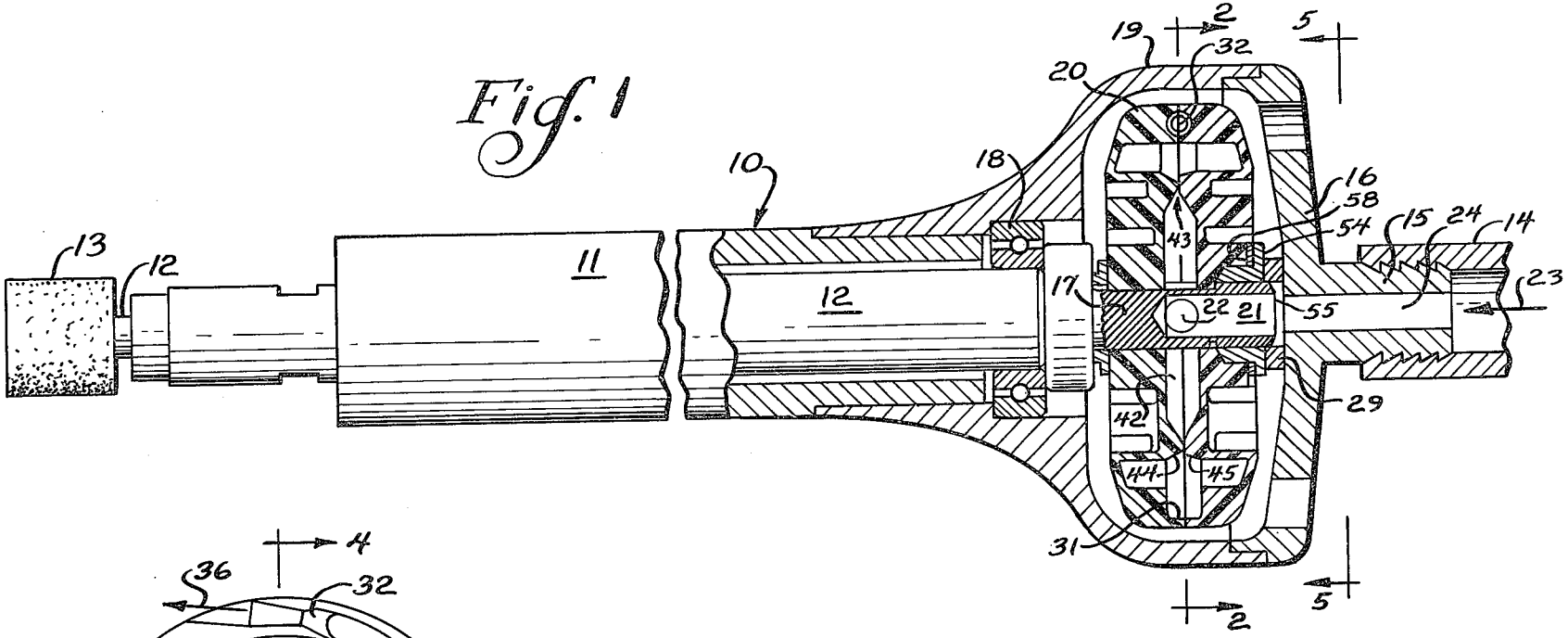
FIG. 1 is a side elevational view partially in section of a hand held high speed grinder operated by compressed air and illustrating one embodiment of the invention.

In the embodiment illustrated in the drawings the rotary device 10 comprises an elongated casing 11 having a rotatable shaft 12 whose forward end carries a grinding wheel 13 externally of the casing 11. The rotary device of this invention converts pressurized fluid such as compressed air into rotary power and is provided with a source of compressed air including a flexible tube 14 connected to a tubular inlet 15 that is integral with the rear cover 16 of the casing 11.

The rear end 17 of the shaft 12 beyond a rear shaft supporting bearing 18 is located axially of an enlarged circular rear chamber 19 and has mounted on this rear shaft end 17 a rotor 20 made of a flexible elastomer such as "Zytel 101".

As can be seen in FIG. 1 the extreme rear o this shaft end 17 has an axial rearwardly extending opening 21 that intersects a pair of oppositely extending openings 22 lying on a diameter of the shaft end 17 so that compressed air 23 flowing into a supply passage 24 will be directed by way of the openings 21 and 22 into the interior of the flexible rotor 20. A seal 29 of any desired structure such as that shown in the above U.S. Pat. No. 3,733,113 may be provided in the area within the rear chamber 19 surrounding the supply passage 24 and duct opening 21.

Figure 2:
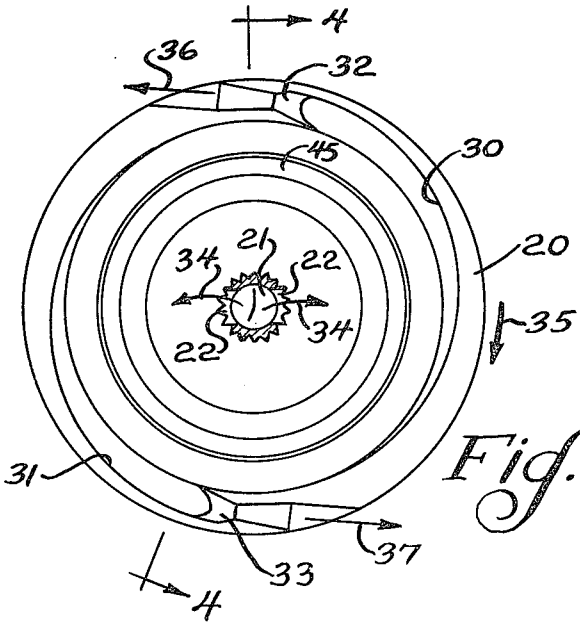
FIG. 2 is a transverse sectional view taken substantially along line 2—2 of FIG. 1.

The flexible rotor 20 is provided with internal torque imparting surfaces illustrated by the two symmetrically positioned Archimedean spiral surfaces 30 and 31 each leading at their ends of greatest curvature to converging-diverging nozzles 32 and 33 respectively. The air flow 34 into the flexible rotor 20 and then radially outwardly as indicated by the arrows in FIG. 2 operates against these surfaces 30 and 31 to set up rotation 35 in the rotor and is exhausted through the nozzles as indicated by the exhaust arrows 36 and 37 further adding to the torque that establishes the rotation 35. Between the fluid inlets 21 and 22 to the exterior chamber 42 in the rotor 20 and the arcuate surfaces 30 and 31 and the nozzles 32 and 33 there is provided a centrifugally operated valve means 43 for restricting flow of fluid to these rotation imparting surfaces and nozzles 30–33. This valve means comprises separable elements 44 and 45 with the element 44 comprising a circular peaked ridge operating against a flat surface on the other valve element 45.

Figure 4:
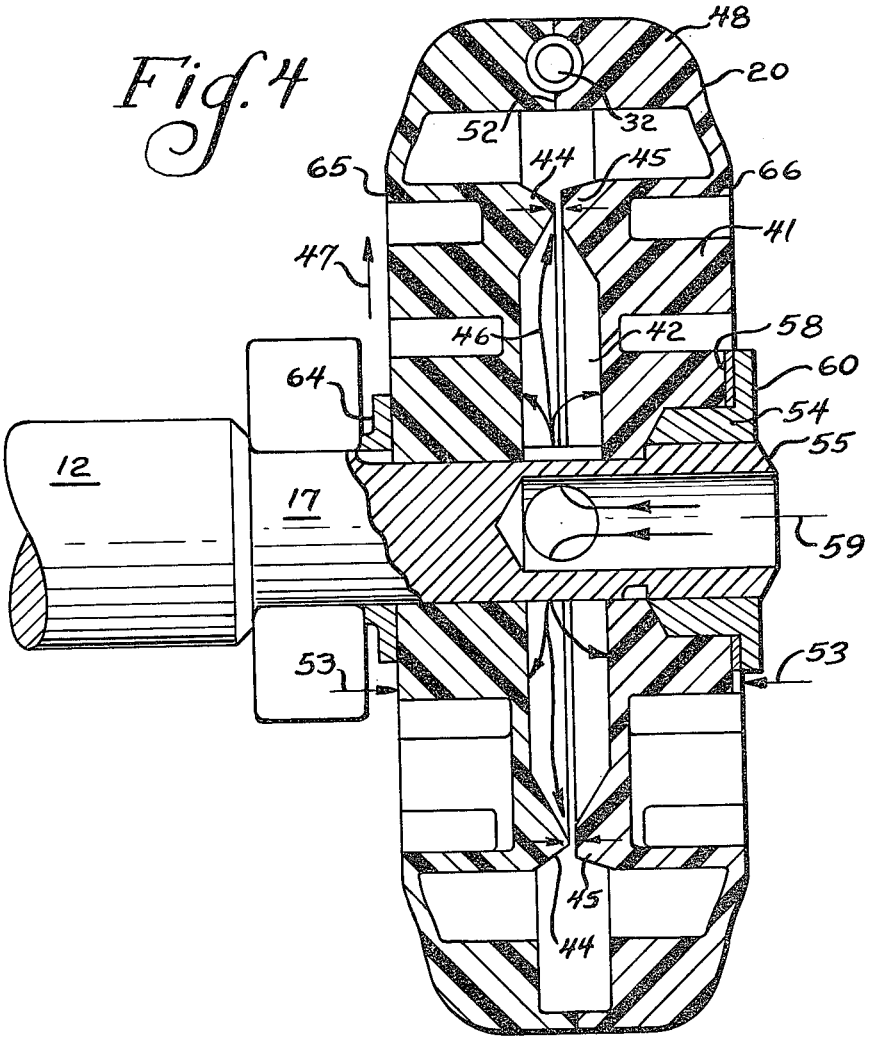
FIG. 4 is an enlarged sectional view taken substantially along line 4—4 of FIG. 2.
Figure 5:
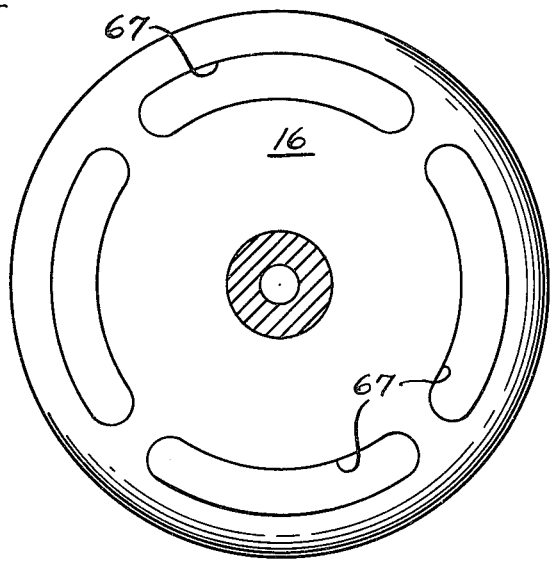
FIG. 5 is a sectional view taken substantially along line 5—5 of FIG. 1.

As is illustrated by the fluid flow arrows 46 in the enlarged sectional view of FIG. 4, these elements 44 and 45 are held apart during rotation of the rotor by the internal pressure of the fluid within the chamber 42. This permits the pressurized fluid which in this case is air to reach the torque imparting elements 30–33 and thereby establish rotation of the rotor 20, the shaft 12 and the grinding wheel 13. The valve elements 44 and 45 extend entirely around the inside of the rotor and therefore when closed serve to intercept the air supply 34.

As can be seen in FIG. 4 when the rotor is rotating toward maximum speed the separable valve elements 44 and 45 are separated so as to permit the internal air flow to reach the surfaces 30 and 31 and the nozzles 32 and 33. When the rotation approaches maximum, however, the centrifugal forces indicated by the arrows 47 become sufficiently great because of the distribution of mass of the rotor and particularly the segments 41 to draw the separable valve element ridges 44 and 45 together to restrict the air supply to the torque imparting elements 30–33 and effectively limit the speed of rotation to a maximum.

As can be seen the integral rotor and speed governor of this invention lends itself readily to mass production as the rotor parts are molded and then assembled by joining the two halves of the rotor at a diameter seam 52. In order to establish a preselected maximum speed such as 65,000 rpm, for example, in a large series of these rotors a set adjustable feature is included. This adjustable feature applies a prestress laterally as indicated in FIG. 4 by the arrows 53 and comprises a threaded nut 54 threaded to the end surface 55 of the end 17 of the shaft 12 which comprises the axle for the rotor 20.

Figure 3:
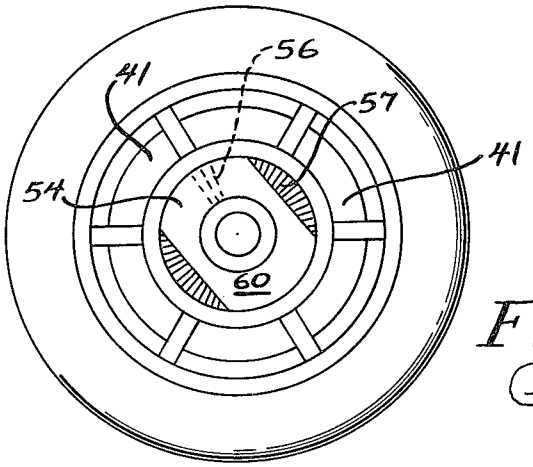
FIG. 3 is an end elevational view of the rotor taken from the right side of the rotor as viewed in FIG. 1.

The nut 54 as shown in FIG. 3 is transversely elongated and has a radially knurled 56 inner surface engaging similar knurls 57 on an annular insert 58 that is located against the outer surface of the rotor between the axis of rotation 59 and a radial flange 60 that forms a part of the nut 54. The knurls 56 and 57 are provided so that the nut 54 will be held in adjusted position when turned to set up the prestress 53 thereby compressing the central portion of the rotor between the nut flange and a stop member 64 on the opposite side or front face of the rotor. Thus the nut 54 functions as a base member for laterally compressing the flexible rotor between the nut flange 60 and the stop 64 to preset the maximum speed at which the centrifugal forces 47 will draw the valve elements 44 and 45 into contact as shown in FIG. 1 and thereby restricting access of the pressurized fluid 46 to the rotor torque imparting elements.

After the air 36 has passed from the rotor into the rear chamber 19 it is permitted to escape through vent openings 67 in the rear cover 16.

In one embodiment of the invention the grinders were designed to operate at 65,000 rpm of air at 80 psig. Several sets of the two rotor halves 65 and 66 were produced by machining and then were assembled by joining at the seams 52. Although the rotors were all designed to operate with 65,000 rpm of air it was found that there was some variation between the rotors. However, because of the adjustment features 54–58, 60 and 64 the rotors could be prestressed as indicated at 53 so as to achieve substantially the desired maximum speed of 65,000 rpm.

I claim:

1. A speed governed rotary device, comprising: a centrifugally radially expandable rotor having a drive surface acted upon by pressurized fluid for rotating the rotor and a fluid passage in said rotor to said surface including an inlet for said fluid; valve means in said rotor fluid passage openable under internal fluid pressure and movable upon centrifugal expansion of said rotor to restrict flow of said fluid in said passage to said surface upon centrifugal expansion of said rotor, thereby restricting the speed of rotation of said rotor to a maximum; and means for applying a prestress to said valve means for preselecting said maximum speed comprising an axle for said rotor at the axis of rotation of said rotor extending through one side of the rotor and a movable base member adjacent to said axis movable relative to said axle and engaging one side of said rotor.

2. The device of claim 1 wherein said axle is threaded, said rotor has opposite sides, said base member comprises a nut engaging the threads and having a peripheral portion engaging said one side of said rotor and there is provided a stop member adjacent to said axis engaging the opposite side of the rotor opposite to said nut.

3. The device of claim 2 wherein said stop member is annular, there is provided a radially knurled annular member attached to said one side of the rotor engaged by said nut and similar knurls are provided on said nut engaging the knurls of said annular member, the engaged knurls thereby permitting stepwise angular adjustment of said prestress.

4. A speed governed rotary device, comprising: a hollow rotor having a drive surface acted upon by pressurized fluid for rotating said rotor and a fluid passage in said rotor to said surface including an inlet substantially at the center of said rotor for said fluid; centrifugally operated valve means extending for approximately 360° in said rotor fluid passage for restricting flow of said fluid to said surface upon rotation of said rotor for thereby governing the speed of rotation of said rotor to a preselected maximum; and means for applying a prestress to said valve means for preselecting said maximum speed comprising an axle for said rotor at the axis of rotation of said rotor extending through one side of the rotor and a movable base member adjacent to said axis movable relative to said axle and engaging one side of said rotor.

5. The device of claim 4 wherein said axle is threaded, said rotor has opposite sides, said base member comprises a nut engaging the threads and having a peripheral portion engaging said one side of said rotor and there is provided a stop member adjacent to said axis engaging the opposite side of the rotor opposite to said nut.

6. The device of claim 5 wherein said stop member is annular, there is provided a radially knurled annular member attached to said one side of the rotor engaged by said nut and similar knurls are provided on said nut engaging the knurls of said annular member, the engaged knurls thereby permitting stepwise angular adjustment of said prestress.

7. A speed governed rotary device, comprising: a hollow flexible rotor expandable radially under centrifugal forces having a drive surface acted upon by pressurized fluid for rotating the rotor and a fluid passage in said rotor to said surface including an inlet for said fluid spaced from said surface; valve means in said fluid passage between said inlet and said surface for controlling the supply of said pressurizes fluid to said surface and thereby the speed of rotation of said rotor; valve operating means on said rotor tending to close said valve means upon said centrifugal expansion of said rotor to control the speed thereof to a preselected maximum; and means for applying a prestress to said valve means for preselecting said maximum speed comprising an axle for said rotor at the axis of rotation of said rotor extending through one side of the rotor and a movable base member adjacent to said axis movable relative to said axle and engaging one side of said rotor.

8. the device of claim 7 wherein said axle is threaded, said rotor has opposite sides, said base member comprises a nut engaging the threads and having a peripheral portion engaging said one side of said rotor and there is provided a stop member adjacent to said axis engaging the opposite side of the rotor opposite to said nut.

9. The device of claim 8 wherein said stop member is annular, there is provided a radially knurled anular member attached to said one side of the rotor engaged by said nut and similar knurls are provided on said nut engaging the knurls of said annular member, the engaged knurls thereby permitting stepwise angular adjustment of said prestress.

* * * * *